US011572599B2

(12) United States Patent
Pipard et al.

(10) Patent No.: US 11,572,599 B2
(45) **Date of Patent: *Feb. 7, 2023**

(54) COLD ROLLED HEAT TREATED STEEL SHEET AND A METHOD OF MANUFACTURING THEREOF

(71) Applicant: ArcelorMittal, Luxembourg (LU)

(72) Inventors: Jean-Marc Pipard, Vaux (FR); Artem Arlazarov, Blenod les Pont a Mousson (FR)

(73) Assignee: ArcelorMittal, Luxembourg (LU)

( * ) Notice: Subject to any disclaimer, the term of this patent is extended or adjusted under 35 U.S.C. 154(b) by 145 days.

This patent is subject to a terminal disclaimer.

(21) Appl. No.: 16/761,319

(22) PCT Filed: Nov. 5, 2018

(86) PCT No.: PCT/IB2018/058664

§ 371 (c)(1),
(2) Date: May 4, 2020

(87) PCT Pub. No.: WO2019/092576

PCT Pub. Date: May 16, 2019

(65) Prior Publication Data

US 2021/0207236 A1 Jul. 8, 2021

(30) Foreign Application Priority Data

Nov. 10, 2017 (WO) ..... PCT/IB2017/057041

(51) Int. Cl.

| | |
|---|---|
| ***C21D 9/46*** | (2006.01) |
| ***C21D 6/00*** | (2006.01) |
| ***C21D 8/02*** | (2006.01) |
| ***C22C 38/00*** | (2006.01) |
| ***C22C 38/02*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/54*** | (2006.01) |
| ***C22C 38/58*** | (2006.01) |

(52) U.S. Cl.

CPC ..... *C21D 9/46* (2013.01); *C21D 6/004* (2013.01); *C21D 6/005* (2013.01); *C21D 6/007* (2013.01); *C21D 6/008* (2013.01); *C21D 8/0205* (2013.01); *C21D 8/0226* (2013.01); *C21D 8/0236* (2013.01); *C21D 8/0263* (2013.01); *C22C 38/001* (2013.01); *C22C 38/002* (2013.01); *C22C 38/02* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C22C 38/54* (2013.01); *C22C 38/58* (2013.01); *C21D 2211/001* (2013.01); *C21D 2211/002* (2013.01); *C21D 2211/008* (2013.01)

(58) Field of Classification Search

CPC ..... C21D 9/46

See application file for complete search history.

(56) References Cited

U.S. PATENT DOCUMENTS

| | | | |
|---|---|---|---|
| 2014/0000765 | A1 | 1/2014 | Nozaki et al. |
| 2014/0238557 | A1 | 8/2014 | Haga et al. |
| 2015/0034219 | A1 | 2/2015 | Kawabe et al. |
| 2016/0369369 | A1 | 12/2016 | Takashima et al. |
| 2017/0101695 | A1 | 4/2017 | Arlazarov et al. |

(Continued)

FOREIGN PATENT DOCUMENTS

| | | | |
|---|---|---|---|
| CN | 103842541 | A | 6/2014 |
| CN | 104160055 | A | 11/2014 |
| CN | 103797135 | A | 4/2015 |
| CN | 105039851 | A | 11/2015 |
| CN | 105940134 | A | 9/2016 |
| CN | 106244918 | A | 12/2016 |
| CN | 106661658 | A | 5/2017 |
| CN | 107075627 | A | 8/2017 |
| EP | 2660345 | | 11/2013 |
| EP | 3009527 | | 4/2016 |

(Continued)

OTHER PUBLICATIONS

International Search Report of PCT/IB2018/058664, dated Jan. 2, 2019.

*Primary Examiner* — Jophy S. Koshy
(74) *Attorney, Agent, or Firm* — Davidson, Davidson & Kappel, LLC

(57) ABSTRACT

A cold rolled and heat treated steel sheet having a composition with the following elements, expressed in percentage by weight: 0.10%≤Carbon≤0.5%,1%≤Manganese≤3.4%, 0.5%≤Silicon≤2.5%, 0.03%≤Aluminum≤1.5%, 0%≤Sulfur≤0.003% 0.002%≤Phosphorus≤0.02%, 0%≤Nitrogen≤0.01% and can contain one or more of the following optional elements 0.05%≤Chromium≤1%, 0.001%≤Molybdenum≤0.5%, 0.001%≤Niobium≤0.1%, 0.001%≤Titanium≤0.1%, 0.01%≤Copper≤2%, 0.01%≤Nickel≤3%, 0.0001%≤Calcium≤0.005%, 0%≤Vanadium≤0.1%, 0%≤Boron≤0.003%, 0%≤Cerium≤0.1%, 0%≤Magnesium≤0.010%, 0%≤Zirconium≤0.010% the remainder composition being composed of iron and unavoidable impurities caused by processing, the microstructure of the steel sheet having in area fraction, 10 to 30% Residual Austenite, 10 to 40% Bainite, 5% to 50% Annealed Martensite, 1% to 20% Quenched Martensite and less than 30% Tempered Martensite, wherein the cumulated amounts of Bainite and Residual Austenite is more than or equal to 25%.

16 Claims, No Drawings

(56) References Cited

U.S. PATENT DOCUMENTS

| | | | | |
|---|---|---|---|---|
| 2017/0107591 | A1* | 4/2017 | Takashima | C22C 38/001 |
| 2017/0175219 | A1 | 6/2017 | Kawasaki et al. | |
| 2018/0171459 | A1 | 6/2018 | Drillet et al. | |
| 2018/0298462 | A1 | 10/2018 | Sano et al. | |
| 2020/0354823 | A1* | 11/2020 | Pipard | C22C 38/54 |

FOREIGN PATENT DOCUMENTS

| | | | | |
|---|---|---|---|---|
| EP | 3128023 | | 2/2017 | |
| EP | 3144406 | | 3/2017 | |
| EP | 3219821 | | 9/2017 | |
| JP | 2013072101 | A | 4/2013 | |
| JP | 2016113649 | A | 6/2016 | |
| JP | 2016191125 | A | 11/2016 | |
| KR | 20130123460 | A | 11/2013 | |
| WO | WO-2015151427 | A1 * | 10/2015 | C22C 38/16 |
| WO | WO2016198906 | A1 | 12/2016 | |
| WO | WO2016199922 | A1 | 12/2016 | |

* cited by examiner

COLD ROLLED HEAT TREATED STEEL SHEET AND A METHOD OF MANUFACTURING THEREOF

The present invention relates to cold rolled heat and treated steel sheets suitable for use as steel sheets for automobiles.

BACKGROUND

Automotive parts are required to satisfy two inconsistent requirements, namely ease of forming and strength, but in recent years a third requirement of improvement in fuel consumption by reducing weight is also required in view of global environment concerns. Thus, now automotive parts must be made of material having high formability, in order to meet the criteria of ease of fit in the intricate automobile assembly, and at same time have to improve strength for vehicle crashworthiness and durability while reducing weight of vehicle to improve fuel efficiency.

Therefore, intense research and development endeavors have been undertaken to reduce the amount of material utilized in car by increasing the strength of material. Conversely, an increase in strength of steel sheets decreases formability, and thus development of materials having both high strength and high formability is necessitated.

Earlier research and developments in the field of high strength and high formability steel sheets have resulted in several methods for producing high strength and high formability steel sheets, some of which are enumerated herein for appreciation of the present invention:

EP3128023 mentions a high-strength cold-rolled steel sheet having excellent elongation, hole expandability, and delayed fracture resistance and high yield ratio, and a method for producing the steel sheet. A high-yield-ratio, high-strength cold-rolled steel sheet has a composition containing, in terms of % by mass, C: 0.13% to 0.25%, Si: 1.2% to 2.2%, Mn: 2.0% to 3.2%, P: 0.08% or less, S: 0.005% or less, Al: 0.01% to 0.08%, N: 0.008% or less, Ti: 0.055% to 0.130%, and the balance being Fe and unavoidable impurities. The steel sheet has a microstructure that contains 2% to 15% of ferrite having an average crystal grain diameter of 2 μm or less in terms of volume fraction, 5 to 20% of retained austenite having an average crystal grain diameter of 0.3 to 2.0 μm in terms of volume fraction, 10% or less (including 0%) of martensite having an average grain diameter of 2 μm or less in terms of volume fraction, and the balance being bainite and tempered martensite, and the bainite and the tempered martensite having an average crystal grain diameter of 5 μm or less.

EP3009527 provides a high-strength cold-rolled steel sheet having excellent elongation, excellent stretch flangeability, and high yield ratio and a method for manufacturing the same. The high-strength cold-rolled steel sheet has a composition and a microstructure. The composition contains 0.15% to 0.27% C, 0.8% to 2.4% Si, 2.3% to 3.5% Mn, 0.08% or less P, 0.005% or less S, 0.01% to 0.08% Al, and 0.010% or less N on a mass basis, the remainder being Fe and inevitable impurities. The microstructure comprises: ferrite having an average grain size of 5 μm or less and a volume fraction of 3% to 20%, retained austenite having a volume fraction of 5% to 20%, and martensite having a volume fraction of 5% to 20%, the remainder being bainite and/or tempered martensite. The total number of retained austenite with a grain size of 2 μm or less, martensite with a grain size of 2 μm or less, or a mixed phase thereof is 150 or more per 2,000 μm 2 of a thickness cross section parallel to the rolling direction of the steel sheet.

EP3144406 discloses a high-strength cold-rolled steel sheet having excellent ductility that comprises by wt. %, carbon (C): 0.1% to 0.3%, silicon (Si): 0.1% to 2.0%, aluminum (Al): 0.005% to 1.5%, manganese (Mn): 1.5% to 3.0%, phosphorus (P): 0.04% or less (excluding 0%), sulfur (S): 0.015% or less (excluding 0%), nitrogen (N): 0.02% or less (excluding 0%), and a remainder of iron (Fe) and inevitable impurities wherein a sum of Si and Al (Si+Al) (wt %) satisfies 1.0% or more, and wherein a microstructure comprises: by area fraction, 5% or less of polygonal ferrite having a minor axis to major axis ratio of 0.4 or greater, 70% or less (excluding 0%) of acicular ferrite having a minor axis to major axis ratio of 0.4 or less, 25% or less (excluding 0%) of acicular retained austenite, and a remainder of martensite. Further EP3144406 foresees a high strength steel with a tensile strength of 780 MPa or more but not able to reach the yield strength of 600 MPa or more hence lacks formability especially for the skin and anti-intrusion parts of the automobile.

SUMMARY OF THE INVENTION

An object of the present invention is to solve these problems by making available cold-rolled steel sheets that simultaneously have:

- an ultimate tensile strength greater than or equal to 900 MPa and preferably above 980 MPa,
- an total elongation greater than or equal to 14% and preferably above 18%.
- a yield strength of 550 MPa or more.

The present invention provides a cold rolled and heat treated steel sheet having a composition comprising of the following elements, expressed in percentage by weight:

0.10%≤Carbon≤0.5%
1%≤Manganese≤3.4%
0.5%≤Silicon≤2.5%
0.03%≤Aluminum≤1.5%
0%≤Sulfur≤0.003%.
0.002%≤Phosphorus≤0.02%
0%≤Nitrogen≤0.01% and can contain one or more of the following optional elements 0.05%≤Chromium≤1%
0.001%≤Molybdenum≤0.5%
0.001%≤Niobium≤0.1%
0.001%≤Titanium≤0.1%
0.01%≤Copper≤2%
0.01%≤Nickel≤3%
0.0001%≤Calcium≤0.005%
0%≤Vanadium≤0.1%
0%≤Boron≤0.003%
0%≤Cerium≤0.1%
0%≤Magnesium≤0.010%
0%≤Zirconium≤0.010% the remainder composition being composed of iron and unavoidable impurities caused by processing, the microstructure of said steel sheet comprising in area fraction, 10 to 30% Residual Austenite, 10 to 40% Bainite, 5% to 50% Annealed Martensite, 1% to 20% Quenched Martensite and less than 30% Tempered Martensite, wherein the cumulated amounts of Bainite and Residual Austenite is more than or equal to 25%.

In a preferred embodiment, the steel sheets according to the invention may also present a yield strength to tensile strength ratio of 0.5 or more.

Preferably, such steel can also have a good suitability for forming, in particular for rolling with good weldability and coatability.

Another alternate or additonal object of the present invention is to make available a method for the manufacturing of these sheets that is compatible with conventional industrial applications while being robust towards manufacturing parameters shifts.

The present invention provides a method of production of a cold rolled heat treated steel sheet comprising the following successive steps:

providing the steel composition;

reheating said semi-finished product to a temperature between 1200° C. and 1280° C.;

rolling the said semi-finished product in the austenitic range wherein the hot rolling finishing temperature shall be above Ac3 to obtain a hot rolled steel sheet;

cooling the sheet at a cooling rate above 30° C./s to a coiling temperature which is below 600° C.; and coiling the said hot rolled sheet;

cooling the said hot rolled sheet to room temperature;

optionally performing scale removal process on said hot rolled steel sheet;

optionally annealing is performed on hot rolled steel sheet at temperature between 400° C. and 750° C.;

optionally performing scale removal process on said hot rolled steel sheet;

cold rolling the said hot rolled steel sheet with a reduction rate between 35 and 90% to obtain a cold rolled steel sheet;

then performing a first annealing by heating the said cold rolled steel sheet at a rate greater than 3° C./s to a soaking temperature between Ac3 and Ac3+100° C. where it is held during 10 to 500 seconds;

then cooling the sheet at a rate greater than 20° C./s to a temperature below 500° C.;

optionally performing tempering the said annealed steel sheet between 120° C. and 250° C.;

then performing a second annealing by heating the said annealed cold rolled steel sheet at a rate greater than 3° C./s to a soaking temperature between $T_{soaking}$ and Ac3 where it is held during 10 to 500 seconds;

then cooling the sheet at a rate greater than 20° C./s to a temperature range between $Tc_{max}$ and $Tc_{min}$ wherein:

$Tc_{max}$=565−601*(1-Exp(−0.868*C))−34*Mn−13*Si−10*Cr+13*Al−361*Nb $Tc_{min}$=565−601*(1-Exp(−1.736*C))−34*Mn−13*Si−10*Cr+13*Al−361*Nb wherein C, Mn, Si, Cr, Al and Nb are in wt. % of the elements in the steel.

then the said annealed cold rolled steel sheet is brought to temperature range between 350° C. and 550° C. during 5 to 500 seconds and the said annealed cold rolled steel sheet is cooled down to room temperature with a cooling rate of at least 1° C./s to obtain cold rolled heat treated steel sheet.

The cold rolled and heat treated steel sheet of the present invention may optionally be coated with zinc or zinc alloys, or with aluminium or aluminium alloys to improve its corrosion resistance.

DETAILED DESCRIPTION

Carbon is present in the steel between 0.10% and 0.5%. Carbon is an element necessary for increasing the strength of the steel sheet by producing low-temperature transformation phases such as martensite, further Carbon also plays a pivotal role in Austenite stabilization hence a necessary element for securing Residual Austenite. Therefore, Carbon plays two pivotal roles one in increasing the strength and another in retaining austenite to impart ductility. But Carbon content less than 0.10% will not be able to stabilize Austenite in an adequate amount required by the steel of present invention. On the other hand, at a Carbon content exceeding 0.5%, the steel exhibits poor spot weldability which limits its application for the automotive parts.

Manganese content of the steel of present invention is between 1% and 3.4%. This element is gammagenous. The purpose of adding Manganese is essentially to obtain a structure that contains Austenite and impart strength to the steel. An amount of at least 1% by weight of Manganese has been found in order to provide the strength and hardenability of the steel sheet as well as to stabilize Austenite. Thus, a higher percentage of Manganese is preferred by the present invention such as up to 3.4%. But when Manganese content is more than 3.4% it produces adverse effects such as it retards transformation of Austenite to Bainite during the isothermal holding for Bainite transformation. In addition the Manganese content of above 3.4% also reduces the ductility and also deteriorates the weldability of the present steel hence the ductility targets may not be achieved. The preferable range for Manganese is 1.2% and 2.3% and a more preferable range is between 1.2% and 2.2%.

Silicon content of the steel of present invention is between 0.5% and 2.5%. Silicon is a constituent that can retard the precipitation of carbides during overageing, therefore, due to the presence of Silicon, carbon rich Austenite is stabilized at room temperature. Further, due to poor solubility of Silicon in carbide it effectively inhibits or retards the formation of carbides, hence also promotes the formation of low density carbides in Bainitic structure which is sought as per the present invention to impart steel with its essential features. However, disproportionate content of Silicon does not produce the mentioned effect and leads to a problem such as temper embrittlement. Therefore, the concentration is controlled within an upper limit of 2.5%.

The content of the Aluminum is between 0.03 and 1.5%. In the present invention Aluminum removes oxygen existing in molten steel to prevent oxygen from forming a gas phase. Aluminum also fixes Nitrogen in the steel to form Aluminum nitride so as to reduce the size of the grains. Higher content of Aluminum that is of above 1.5%, increases Ac3 point to a high temperature thereby lowering the productivity. Aluminum content between 1.0 and 1.5% is used in the present invention when high Manganese content is added in order to counterbalance the effect of Manganese on transformation points such as Ac3 and Austenite formation evolution with temperature.

Chromium content of the steel of the present invention is between 0.05% and 1%. Chromium is an essential element that provides strength and hardening to the steel but when used above 1% it impairs surface finish of steel. Further Chromium contents under 1% coarsen the dispersion pattern of carbide in Bainitic structures, hence, keep the density of carbides low in Bainite.

Phosphorus constituent of the steel of the present invention is between 0.002% and 0.02%. Phosphorus reduces the spot weldability and the hot ductility, particularly due to its tendency to segregate at the grain boundaries or co-segregate with manganese. For these reasons, its content is limited to 0.02% and preferably lower than 0.013%.

Sulfur is not an essential element but may be contained as an impurity in steel and from point of view of the present invention the Sulfur content is preferably as low as possible, but is 0.003% or less from the viewpoint of manufacturing cost. Further if higher Sulfur is present in steel it combines to form Sulfides especially with Manganese and reduces its beneficial impact on the steel of the present invention.

Niobium is present in the steel between 0.001 and 0.1% and is added in the steel of the present invention for forming carbo-nitrides to impart strength of the steel of the present invention by precipitation hardening. Niobium will also impact the size of microstructural components through its precipitation as carbo-nitrides and by retarding the recrystallization during heating process. Thus a finer microstructure formed at the end of the holding temperature and as a consequence after the completion of annealing that will lead to the hardening of the steel of the present invention. However, Niobium content above 0.1% is not economically interesting as a saturation effect of its influence is observed and this means that additional amount of Niobium does not result in any strength improvement of the product.

Titanium is added to the steel of the present invention between 0.001% and 0.1%. As Niobium, it is involved in carbo-nitrides formation so plays a role in hardening of the steel of the present invention. In addition Titanium also forms Titanium-nitrides which appear during solidification of the cast product. The amount of Titanium is so limited to 0.1% to avoid formation of coarse Titanium-nitrides detrimental for formability. In case the Titanium content is below 0.001% it does not impart any effect on the steel of the present invention.

Calcium content in the steel of the present invention is between 0.0001% and 0.005%. Calcium is added to steel of the present invention as an optional element especially during the inclusion treatment. Calcium contributes towards the refining of the steel by arresting the detrimental Sulfur content in globular form, thereby, retarding the harmful effects of Sulfur.

Copper may be added as an optional element in an amount of 0.01% to 2% to increase the strength of the steel and to improve its corrosion resistance. A minimum of 0.001% of Copper is required to get such effect. However, when its content is above 2%, it can degrade the surface aspects.

Nickel may be added as an optional element in an amount of 0.01 to 3% to increase the strength of the steel and to improve its toughness. A minimum of 0.01% is required to produce such effects. However, when its content is above 3%, Nickel causes ductility deterioration.

Molybdenum is an optional element that constitutes 0.001% to 0.5% of the steel of the present invention; Molybdenum plays an effective role in determining hardenability and hardness, delays the appearance of Bainite and avoids carbides precipitation in Bainite. However, the addition of Molybdenum excessively increases the cost of the addition of alloy elements, so that for economic reasons its content is limited to 0.5%.

Nitrogen is limited to 0.01% in order to avoid ageing of material and to minimize the precipitation of Aluminum nitrides during solidification which are detrimental for mechanical properties of the Steel.

Vanadium is effective in enhancing the strength of steel by forming carbides or carbo-nitrides and the upper limit is 0.1% due to the economic reasons. Other elements such as Cerium, Boron, Magnesium or Zirconium can be added individually or in combination in the following proportions by weight: Cerium≤0.1%, Boron≤0.003%, Magnesium≤0.010% and Zirconium≤0.010%. Up to the maximum content levels indicated, these elements make it possible to refine the grain during solidification. The remainder of the composition of the Steel consists of iron and inevitable impurities resulting from processing.

The microstructure of the steel sheet comprises:

Annealed Martensite in the steel of the present invention is between 5% and 50% by area fraction. The major constituents of the steel of the present invention in terms of microstructure after the first annealing cycle is Quenched Martensite or Tempered Martensite obtained during continuous cooling from holding temperature and eventual tempering. This Quenched Martensite or Tempered Martensite is then annealed during the second annealing. Depending on the soaking temperature of the second annealing, the area fraction of the Annealed Martensite will be at least 5% in case of annealing close to the fully Austenitic domain or will be limited to 50% in case of inter-critical holding.

Quenched Martensite constitutes between 1% and 20% of microstructure by area fraction. Quenched Martensite imparts strength to the Steel of present invention. Quenched Martensite is formed during the final cooling of the second annealing. No minimum is required but when Quenched Martensite is in excess of 20% it imparts excess strength but deteriorates other mechanical properties beyond acceptable limit.

Tempered Martensite constitutes between 0 and 30% of microstructure by area fraction. Martensite can be formed when steel is cooled between $Tc_{min}$ and $Tc_{max}$ and is tempered during the overaging holding. Tempered Martensite imparts ductility and strength to the steel of the present invention. When Tempered Martensite is in excess of 30% it imparts excess strength but diminishes the elongation beyond acceptable limit. Further Tempered Martensite diminishes the gap in hardness of soft phases such as Residual Austenite and hard phases such as Quenched Martensite.

Bainite constitutes from 10% to 40% of microstructure by area fraction for the steel of the present invention. In the present invention, Bainite cumulatively consists of Lath Bainite and Granular Bainite, where Granular Bainite has a very low density of carbides, low density of carbides herein means the presence of carbide count to be less than or equal to 100 carbides per area unit of 100 $\mu m^2$ and having a high dislocation density which impart high strength as well as elongation to the steel of present invention. The Lath Bainite is in the form of thin Ferrite laths with Austenite or carbides formed in between the laths. The Lath Bainite of the steel of the present invention provides the steel with adequate formability. To ensure an elongation of 14% and preferably 15% or more it is necessary to have 10% of Bainite.

Residual Austenite constitutes from 10% to 30% by area fraction of the steel. Residual Austenite is known to have a higher solubility of Carbon than Bainite and, hence, acts as effective Carbon trap, therefore, retarding the formation of carbides in Bainite. Carbon percentage inside the Residual Austenite of present invention is preferably higher than 0.9% and preferably lower than 1.1%. Residual Austenite of the steel according to the invention imparts an enhanced ductility.

In addition to the above-mentioned microstructure, the microstructure of the cold rolled and heat treated steel sheet is free from microstructural components, such as pearlite, ferrite and cementite without impairing the mechanical properties of the steel sheets.

A steel sheet according to the invention can be produced by any suitable method. A preferred method consists in providing a semi-finished casting of steel with a chemical composition according to the invention. The casting can be done either into ingots or continuously in form of thin slabs or thin strips, i.e. with a thickness ranging from approximately 220 mm for slabs up to several tens of millimeters for thin strip.

For example, a slab having the above-described chemical composition is manufactured by continuous casting wherein the slab optionally underwent the direct soft reduction during the continuous casting process to avoid central segregation and to ensure a ratio of local Carbon to nominal Carbon kept below 1.10. The slab provided by continuous casting process can be used directly at a high temperature after the continuous casting or may be first cooled to room temperature and then reheated for hot rolling.

The temperature of the slab, which is subjected to hot rolling, is preferably at least 1200° C. and must be below 1280° C. In case the temperature of the slab is lower than 1200° C., excessive load is imposed on a rolling mill and, further, the temperature of the steel may decrease to a Ferrite transformation temperature during finishing rolling, whereby the steel will be rolled in a state in which transformed Ferrite contained in the structure. Therefore, the temperature of the slab is preferably sufficiently high so that hot rolling can be completed in the temperature range of Ac3 to Ac3+100° C. and a final rolling temperature remains above Ac3. Reheating at temperatures above 1280° C. must be avoided because they are industrially expensive.

A final rolling temperature range between Ac3 to Ac3+100° C. is preferred to have a structure that is favorable to recrystallization and rolling. It is necessary to have final rolling pass to be performed at a temperature greater than Ac3, because below this temperature the steel sheet exhibits a significant drop in rollability. The sheet obtained in this manner is then cooled at a cooling rate above 30° C./s to the coiling temperature which must be below 600° C. Preferably, the cooling rate will be less than or equal to 200° C./s.

The hot rolled steel sheet is then coiled at a coiling temperature below 600° C. to avoid ovalization and preferably below 570° C. to avoid scale formation. The preferred range for such coiling temperature is between 350° C. and 570° C. The coiled hot rolled steel sheet may be cooled down to room temperature before subjecting it to optional hot band annealing or may be send to optional Hot Band annealing directly.

The hot rolled steel sheet may be subjected to an optional scale removal step to remove the scale formed during the hot rolling before optional hot band annealing. The hot rolled sheet may then subjected to an optional Hot Band Annealing at temperatures between 400° C. and 750° C. for at least 12 hours and not more than 96 hours, the temperature remaining below 750° C. to avoid transforming partially the hot-rolled microstructure and, therefore, losing the microstructure homogeneity. Thereafter, an optional scale removal step of this hot rolled steel sheet may performed through, for example, pickling of such sheet. This hot rolled steel sheet is subjected to cold rolling to obtain a cold rolled steel sheet with a thickness reduction between 35 to 90%. The cold rolled steel sheet obtained from cold rolling process is then subjected to two steps of annealing to impart the steel of present invention with microstructure and mechanical properties.

In the first annealing, the cold rolled steel sheet is heated at a heating rate which is greater than 3° C./s, to a soaking temperature between Ac3 and Ac3+100° C. wherein Ac3 for the present steel is calculated by using the following formula:

$$Ac3=901-262*C-29*Mn+31*Si-12*Cr-155*Nb+86*Al$$

wherein the elements contents are expressed in weight percent.

The steel sheet is held at the soaking temperature during 10 to 500 seconds to ensure a complete recrystallization and full transformation to Austenite of the strongly work-hardened initial structure. The sheet is then cooled at a cooling rate greater than 20° C./s until reaching a temperature below 500° C. and preferably below 400° C. Moreover, a cooling rate of at least 30° C./s is preferred to secure the robustness of generation of a single phase martensitic structure after this first annealing.

Then, the cold rolled steel sheet may be optionally tempered between 120° C. and 250° C.

A second annealing of the cold rolled and annealed steel sheet is then performed, by heating it at a heating rate which is greater than 3° C./s, to a soaking temperature between $T_{soaking}$ and Ac3 wherein $$T_{soaking}=830-260*C-25*Mn+22*Si+40*Al$$

wherein the elements contents are expressed in weight percent during 10 to 500s to ensure an adequate re-crystallization and transformation to obtain a minimum of 50% Austenite in the microstructure. The sheet is then cooled at a cooling rate greater than 20° C./s to a temperature in the range between $Tc_{max}$ and $Tc_{min}$. These $Tc_{max}$ and $Tc_{min}$ are defined as follows:

$$Tc_{max}=565-601*(1-Exp(-0.868*C))-34*Mn-13*Si-10*Cr+13*Al-361*Nb$$

$$Tc_{min}=565-601*(1-Exp(-1.736*C))-34*Mn-13*Si-10*Cr+13*Al-361*Nb$$

wherein the elements contents are expressed in weight percent. Thereafter, the cold rolled and annealed steel sheet is brought to a temperature range from 350 to 550° C. and kept there during 5 to 500 seconds to ensure the formation of an adequate amount of Bainite, as well as to temper the Martensite to impart the steel of the present invention with targeted mechanical properties. Afterwards the cold rolled and annealed steel sheet is cooled down to room temperature with a cooling rate of at least 1° C./s to obtain a cold rolled and heat treated steel sheet.

The cold rolled and heat treated steel sheet then may be optionally coated by any of the known industrial processes such as Electro-galvanization, JVD, PVD, Hot dip(Gl/GA) etc. . . . Electro-galvanization is exemplified merely for proper understanding of the present invention. The Electro-galvanization does not alter or modify any of the mechanical properties or microstructure of the cold rolled heat treated steel sheet claimed. Electro-galvanization can be done by any conventional industrial process for instance by Electroplating.

EXAMPLES

The following tests, examples, figurative exemplification and tables which are presented herein are non-restricting in nature and must be considered for purposes of illustration only, and will display the advantageous features of the present invention.

Steel sheets made of steels with different compositions are gathered in Table 1, where the steel sheets are produced according to process parameters as stipulated in Table 2, respectively. Thereafter Table 3 gathers the microstructures of the steel sheets obtained during the trials and Table 4 gathers the result of evaluations of obtained properties.

TABLE 1

| Steel | C | Mn | Si | Al | S | P | N | Cr | Mo | Nb | Ti | Cu | Ni | Ca | V | B |
|---|---|---|---|---|---|---|---|---|---|---|---|---|---|---|---|---|
| 1 | 0.21 | 2.10 | 1.50 | 0.038 | 0.0025 | 0.010 | 0.0052 | 0.344 | 0.002 | 0.002 | 0.0050 | 0.002 | 0.021 | 0.0018 | 0.002 | 0.0006 |
| 2 | 0.21 | 2.10 | 1.50 | 0.038 | 0.0025 | 0.010 | 0.0052 | 0.344 | 0.002 | 0.002 | 0.0050 | 0.002 | 0.021 | 0.0018 | 0.002 | 0.0006 |
| 3 | 0.21 | 2.22 | 1.44 | 0.040 | 0.0010 | 0.011 | 0.0060 | 0.212 | 0.002 | 0.002 | 0.0027 | 0.009 | 0.025 | 0.0018 | 0.004 | 0.0008 |
| 4 | 0.21 | 2.11 | 1.47 | 0.042 | 0.0030 | 0.012 | 0.0038 | 0.367 | 0.002 | 0.001 | 0.0038 | 0.001 | 0.018 | 0.0008 | 0.003 | 0.0005 |
| 5 | 0.39 | 1.52 | 1.49 | 0.037 | 0.0020 | 0.013 | 0.0040 | 0.070 | 0.001 | 0.055 | 0.0010 | 0.001 | 0.010 | 0.0004 | 0.001 | 0.0001 |
| 6 | 0.21 | 2.10 | 1.50 | 0.038 | 0.0025 | 0.010 | 0.0052 | 0.344 | 0.002 | 0.002 | 0.0050 | 0.002 | 0.021 | 0.0018 | 0.002 | 0.0006 |
| 7 | 0.21 | 2.22 | 1.44 | 0.040 | 0.0010 | 0.011 | 0.0060 | 0.212 | 0.002 | 0.002 | 0.0027 | 0.009 | 0.025 | 0.0018 | 0.004 | 0.0008 |
| 8 | 0.21 | 2.22 | 1.44 | 0.040 | 0.0010 | 0.011 | 0.0060 | 0.212 | 0.002 | 0.002 | 0.0027 | 0.009 | 0.025 | 0.0018 | 0.004 | 0.0008 |
| 9 | 0.21 | 2.11 | 1.47 | 0.042 | 0.0030 | 0.012 | 0.0038 | 0.367 | 0.002 | 0.001 | 0.0038 | 0.001 | 0.018 | 0.0008 | 0.003 | 0.0005 |
| 10 | 0.39 | 1.52 | 1.49 | 0.037 | 0.0020 | 0.013 | 0.0040 | 0.070 | 0.001 | 0.055 | 0.0010 | 0.001 | 0.010 | 0.0004 | 0.001 | 0.0001 |

Table 2

Table 2 gathers the annealing process parameters implemented on the steels of Table 1. The steel compositions for trials I1 to 15 serve for the manufacture of sheets according to the invention. This table also specifies the reference steel which are designated in Table 1 for trial R1 to R5. Table 2 also shows a tabulation of $Tc_{min}$ and $Tc_{max}$. These $Tc_{max}$ and $Tc_{min}$ are defined for the inventive steels and reference steels as follows:

$$Tc_{max}=565-601*(1-Exp(-0.868*C))-34*Mn-13*Si-10*Cr+13*Al-361*Nb$$

$$Tc_{min}=565-601*(1-Exp(-1.736*C))-34*Mn-13*Si-10*Cr+13*Al-361*Nb$$

Further, before performing the annealing treatment on the steels of invention as well as on the reference ones, the steels were heated to a temperature between 1000° C. and 1280° C. and then subjected to hot rolling with finish temperature above 850° C. and thereafter were coiled at a temperature below 600° C. The Hot rolled coils were then processed as claimed and thereafter cold rolled with a thickness reduction between 30 to 95%. These cold rolled steel sheets were subjected to heat treatments wherein heating rate for second annealing is 6° C./s for all the steels enumerated in Table 2 and the cooling rate after the soaking of second annealing is 70° C./s for all the steels demonstrated in Table 2.

TABLE 2

| | | | Hot roll | Hot roll | First annealing | | | |
|---|---|---|---|---|---|---|---|---|
| Trials | Steel | Reheating T (° C.) | finishing T (° C.) | Coiling T (° C.) | Heating rate (° C./s) | Soaking T (° C.) | Soaking t (s) | Cooling rate (° C./S) |
| I1 | 1 | 1275 | 910 | 550 | 3.2 | 870 | 155 | 827 |
| I2 | 2 | 1275 | 910 | 550 | 3.2 | 870 | 155 | 827 |
| I3 | 3 | 1220 | 937 | 546 | 6 | 870 | 80 | 1000 |
| I4 | 4 | 1250 | 910 | 450 | 6 | 870 | 80 | 1000 |
| I5 | 5 | 1246 | 904 | 551 | 6 | 820 | 120 | 1000 |
| R1 | 6 | 1275 | 910 | 550 | 3.2 | 870 | 155 | 827 |
| R2 | 7 | 1220 | 937 | 546 | — | — | — | — |
| R3 | 8 | 1220 | 937 | 546 | 6 | 870 | 80 | 1000 |
| R4 | 9 | 1250 | 910 | 450 | 6 | 870 | 80 | 1000 |
| R5 | 10 | 1246 | 904 | 551 | 6 | 820 | 120 | 1000 |

| | | Second annealing | | | | | | | | |
|---|---|---|---|---|---|---|---|---|---|---|
| Trials | Steel | Soaking T (° C.) | Soaking t (s) | Cooling T (° C.) | Holding T (° C.) | Holding t (s) | $T_{Cmax}$ (° C.) | $T_{Cmin}$ (° C.) | Soaking T (° C.) | Ac3 (° C.) |
| I1 | 1 | 770 | 80 | 280 | 460 | 15 | 370 | 247 | 757 | 830 |
| I2 | 2 | 770 | 80 | 300 | 400 | 200 | 370 | 247 | 757 | 830 |
| I3 | 3 | 790 | 80 | 310 | 460 | 15 | 370 | 247 | 754 | 828 |
| I4 | 4 | 770 | 80 | 310 | 400 | 200 | 372 | 249 | 757 | 830 |
| I5 | 5 | 790 | 100 | 260 | 400 | 200 | 301 | 138 | 725 | 795 |
| R1 | 6 | 750 | 80 | 240 | 460 | 15 | 370 | 247 | 757 | 830 |
| R2 | 7 | 770 | 80 | 280 | 400 | 200 | 370 | 247 | 754 | 828 |
| R3 | 8 | 750 | 80 | 240 | 460 | 15 | 370 | 247 | 754 | 828 |
| R4 | 9 | 880 | 80 | 330 | 400 | 200 | 372 | 249 | 757 | 830 |
| R5 | 10 | 830 | 100 | 240 | 400 | 200 | 301 | 138 | 725 | 795 |

I = according to the invention; R = reference; underlined values: not according to the invention.

Table 3

Table 3 exemplifies the results of the tests conducted in accordance with the standards on different microscopes such as Scanning Electron Microscope for determining the microstructures of both the inventive and reference steels.

The results are stipulated herein:

| Trials | Residual Austenite | Bainite | Annealed Martensite | Quenched Martensite | Tempered Martensite | Ferrite | Bainite + Residual Austenite |
|---|---|---|---|---|---|---|---|
| I1 | 16 | 17 | 47 | 08 | 12 | 0 | 33 |
| I2 | 19 | 33 | 45 | 3 | 0 | 0 | 52 |
| I3 | 13 | 14 | 39 | 15 | 19 | 0 | 27 |
| I4 | 18 | 25 | 45 | 7 | 5 | 0 | 43 |
| I5 | 20 | 25 | 12 | 13 | 30 | 0 | 45 |
| R1 | 14 | 2 | 60 | 9 | 15 | 0 | 16 |
| R2 | 12 | 7 | 0 | 21 | 12 | 48 | 19 |
| R3 | 12 | 6 | 58 | 13 | 11 | 0 | 18 |
| R4 | 11 | 18 | 0 | 16 | 55 | 0 | 29 |
| R5 | 3 | 0 | 0 | 27 | 70 | 0 | 3 |

I = according to the invention; R = reference; underlined values: not according to the invention.

Table 4

Table 4 exemplifies the mechanical properties of both the inventive steel and reference steels. In order to determine the tensile strength, yield strength and total elongation, tensile tests are conducted in accordance of JIS Z2241 standards.

The results of the various mechanical tests conducted in accordance to the standards are gathered

TABLE 4

| Trials | Tensile Strength (in MPa) | Yield Strength (in MPa) | Total Elongation (in %) | YS/TS |
|---|---|---|---|---|
| I1 | 1122 | 598 | 21.6 | 0.53 |
| I2 | 1026 | 573 | 25.9 | 0.56 |
| I3 | 1147 | 691 | 15.3 | 0.60 |
| I4 | 1022 | 569 | 22.0 | 0.56 |
| I5 | 1203 | 937 | 27.6 | 0.78 |
| R1 | 1052 | 505 | 21.0 | 0.48 |
| R2 | 1114 | 524 | 15.2 | 0.47 |
| R3 | 1114 | 527 | 18.5 | 0.47 |
| R4 | 1254 | 1021 | 13.0 | 0.81 |
| R5 | 1439 | 1323 | 5.6 | 0.92 |

I = according to the invention; R = reference; underlined values: not according to the invention.

What is claimed is:

1. A cold rolled and heat treated steel sheet having a composition comprising the following elements, expressed in percentage by weight:

0.10%≤Carbon≤0.5%
1%≤Manganese≤3.4%
0.5%≤Silicon≤2.5%
0.03%≤Aluminum≤1.5%
0%≤Sulfur≤0.003%
0.002%≤Phosphorus≤0.02%
0%≤Nitrogen≤0.01%
and optionally one or more of the following elements
0.05%≤Chromium≤1%
0.001%≤Molybdenum≤0.5%
0.001%≤Niobium≤0.1%
0.001%≤Titanium≤0.1%
0.01%≤Copper≤2%
0.01%≤Nickel≤3%
0.0001%≤Calcium≤0.005%
0%≤Vanadium≤0.1%
0%≤Boron≤0.003%
0%≤Cerium≤0.1%
0%≤Magnesium≤0.010%
0%≤Zirconium≤0.010% a remainder being iron and unavoidable impurities caused by processing;

a microstructure of the cold rolled and heat treated steel sheet comprising by area fraction, 10 to 30% Residual Austenite, 10 to 40% Bainite, 5% to 50% Annealed Martensite, 1% to 20% Quenched Martensite and less than 30% Tempered Martensite, wherein the Bainite and the Residual Austenite is more than or equal to 25%, wherein the microstructure is free of pearlite, ferrite and cementite.

2. The cold rolled and heat treated steel sheet as recited in claim 1 wherein the composition includes, in percentage by weight, 1% to 2% of Silicon.

3. The cold rolled and heat treated steel sheet as recited in claim 1 wherein the composition includes, in percentage by weight, 0.03% to 1.0% of Aluminum.

4. The cold rolled and heat treated steel sheet as recited in claim 3 wherein the composition includes, in percentage by weight, 0.03% to 0.6% of Aluminum.

5. The cold rolled and heat treated steel sheet as recited in claim 1 wherein the composition includes, in percentage by weight, 1.2% to 2.3% of Manganese.

6. The cold rolled and heat treated steel sheet as recited in claim 1 wherein the composition includes, in percentage by weight, 0.03% to 0.5% of Chromium.

7. The cold rolled and heat treated steel sheet as recited in claim 1 wherein a sum of the Tempered Martensite, the Quenched Martensite and the Annealed Martensite is more than or equal to 20% by area fraction, and the Annealed Martensite is greater than 10% to 50% by area fraction.

8. The cold rolled and heat treated steel sheet as recited in claim 1 wherein a Carbon content of the Residual Austenite is between 0.9 to 1.1%.

9. The cold rolled and heat treated steel sheet as recited in claim 1 wherein the cold rolled and heat treated steel sheet has an ultimate tensile strength of 950 MPa or more and a total elongation of 15% or more.

10. The cold rolled and heat treated steel sheet as recited in claim 9 wherein the cold rolled and heat treated steel sheet has an ultimate tensile strength of 1000 MPa or more and a yield strength to ultimate tensile strength ratio greater than or equal to 0.5.

11. A structural or safety part of a vehicle comprising the cold rolled and heat treated steel sheet as recited in claim 1.

12. A vehicle comprising the part as recited in claim 11.

13. A method of production of the cold rolled heat treated steel sheet as recited in claim 1 comprising the following successive steps:

providing a semi-finished product with the composition as recited in claim 1;

reheating the semi-finished product to a temperature between 1200° C. and 1280° C.;

rolling the semi-finished product in in a temperature range, in ° C., of Ac3 to Ac3+100° C. wherein a hot rolling finishing temperature is above Ac3 to obtain a hot rolled steel sheet;

cooling the hot rolled steel sheet at a cooling rate above 30° C./s to a coiling temperature below 600° C.; and coiling the hot rolled steel sheet;

cooling the hot rolled sheet to room temperature;

optionally performing a scale removal process on the hot rolled steel sheet;

optionally annealing the hot rolled steel sheet at a temperature between 400° C. and 750° C.;

optionally performing a further scale removal process on the hot rolled steel sheet;

cold rolling the hot rolled steel sheet with a reduction rate between 35 and 90% to obtain a cold rolled steel sheet;

performing a first annealing by heating the cold rolled steel sheet at a rate greater than 3° C./s to a soaking temperature, in ° C., between Ac3 and Ac3+100° C. and holding the cold rolled sheet for a time of 10 to 500 seconds;

cooling the cold rolled sheet at a rate greater than 20° C./s to a temperature below 500° C. to obtain an annealed steel sheet;

optionally performing tempering the annealed steel sheet between 120° C. and 250° C.;

performing a second annealing by heating the annealed steel sheet at a rate greater than 30C/s to a soaking temperature, in ° C., between $T_{soaking}$ and Ac3 and holding the annealed steel sheet for a time of 10 to 500 seconds;

cooling the annealed steel sheet at a rate greater than 20° C./s to a temperature range, in ° C., between $Tc_{max}$ and $Tc_{min}$;

bringing the annealed steel sheet to a temperature range between 350° C. and 550° C. for a time of 5 to 500 seconds and cooling the annealed steel sheet down to room temperature with a cooling rate of at least 10C/s to obtain the cold rolled heat treated steel sheet having the microstructure as recited in claim 1;

wherein $Ac3=901-262*C-29*Mn+31*Si-12*Cr-155*Nb+86*Al$, $T_{soaking}=830-260*C-25*Mn+22*Si+40*Al$, $Tc_{max}=565-601*(1-Exp(-0.868*C))-34*Mn-13*Si-10*Cr+13*Al-361*Nb$, and $Tc_{min}=565-601*(1-Exp(-1.736*C))-34*Mn-13*Si-10*Cr+13*Al-361*Nb$, wherein C, Mn, Si, Cr, Al and Nb in the above equations represent the respective content in percentage by weight of elements in the steel composition.

14. The method as recited in claim 13 wherein the coiling temperature is below 570° C.

15. The method as recited in claim 13 wherein the hot rolling finishing temperature is between Ac3 and Ac3+100° C.

16. The method as recited in claim 13 wherein the coiling temperature is between 350° C. and 570° C.

* * * * *